US005939209A

United States Patent [19]

Shibuya et al.

[11] Patent Number: 5,939,209

[45] Date of Patent: Aug. 17, 1999

[54] PANEL FORMED FROM SORGHUM MILLET FIBERS AND METHOD FOR FORMING THE SAME

[75] Inventors: Fumio Shibuya, Akishima; Yasushi Shibuya, Kasugai, both of Japan

[73] Assignees: Tachi-S Co., Ltd., Tokyo, Japan; Howa Textile Industry Company Limited, Aichi, Japan

[21] Appl. No.: 08/838,029

[22] Filed: Apr. 22, 1997

[51] Int. Cl.[6] ..... B27N 3/12

[52] U.S. Cl. ..... 428/532; 264/115; 264/122; 428/534; 524/15

[58] Field of Search ..... 264/115, 122; 428/532, 534; 524/15

[56] References Cited

U.S. PATENT DOCUMENTS

| | | | |
|---|---|---|---|
| 4,627,951 | 12/1986 | Shen | 264/109 |
| 4,968,549 | 11/1990 | Smimizu et al. | 428/106 |
| 5,217,776 | 8/1993 | Tilby . | |
| 5,248,541 | 9/1993 | Tilby | 428/106 |
| 5,284,546 | 2/1994 | Tilby | 156/583.5 |
| 5,456,964 | 10/1995 | Tamura et al. | 428/105 |
| 5,502,088 | 3/1996 | Hododi | 524/34 |

FOREIGN PATENT DOCUMENTS

| | | |
|---|---|---|
| 04-357023 | 12/1992 | Japan . |
| 05-116239 | 5/1993 | Japan . |
| 07-001409 | 1/1995 | Japan . |
| 07-016964 | 1/1995 | Japan . |
| 07-186110 | 7/1995 | Japan . |
| 07-299810 | 11/1995 | Japan . |

*Primary Examiner*—Mary Lynn Theisen
*Attorney, Agent, or Firm*—Browdy and Neimark

[57] ABSTRACT

Sorghum millet stalks are defibrated and refined into fibers, after which, a cohesive material is admixed with such sorghum millet fibers so as to provide a lump of initially cohered sorghum millet fibers, which is then shaped in the form of a mat. This mat is subjected to a press working process so that a desired shape or uneven shape of panel is produced. During the press working process, the cohesive material is compressed and changed into a state where is acts as a bonding agent to strongly cohere the sorghum millet fibers integrally together. Together with the cohesive material, a bonding material may be admixed with the sorghum millet fibers. Thus, it is possible to obtain a sorghum millet fiber panel which has a strength enough for usual use as with other panels and boards.

17 Claims, No Drawings

PANEL FORMED FROM SORGHUM MILLET FIBERS AND METHOD FOR FORMING THE SAME

BACKGROUND OF INVENTION

1. Field of the Invention

The present invention relates to a panel and a method for forming the same, wherein the panel is used as an interior material such as a ceiling material of a vehicle, a door trim material of a vehicle, a back board of a seat, interior and/or exterior decorative materials of house, or insulators and boards for construction use. In particular, the present invention is directed to a panel of this kind which is formed from plant fibers of "sorghum millet", one of true grasses botanically, and a novel method for forming such panel.

2. Description of Prior Art

Hitherto, in the above-stated sorts of panels, there has been known a lamination structure of panel formed mainly from the stalks of sorghum millet, as disclosed for example from the Japanese Laid-Open Pubs. Nos. 7-16964 and 7-1409.

According to this prior art, the stalks of sorghum millet are compressed to provide plural flattened sorghum millet stalks and thereafter, such plural flattened sorghum millet stalks are so arrayed abreast with one another as to form one sheet of plate-like material. A plurality of the thus-formed plate-like materials are stacked with one another and impregnated with a melt synthetic resin for bonding them together, whereby a lamination-type panel is obtained.

Ecologically, use of sorgum millet for forming panels has been accepted as a good substitute for wood in terms of preserving forest resources, and also the use of sorghum millet has materialized production of a light and robust board. This factor is advantageously effective in forming the panel or board in a desired intricate uneven shape at a low cost in comparison with conventional plywood.

However, the foregoing prior-art panel is found defective in increasing costs in view of its entailing many steps of for treating the sorghum millet stalks, in which the stalks are subjected to impregnation with a liquid curing agent; coating with an adhesive or bonding agent; and being left to dry, for instance. Further, the process for arraying plural raw sorghum millet stalks in this prior art raises a problem of unstable quality because all the natural stalks are not always good in quality, with each of them varied in quality, as a result of which, it has been difficult not only to keep producing a predetermined strength of panel, but also to form a desired uneven three-dimensional shape of panel.

SUMMARY OF INVENTION

With the above-stated problems in view, it is therefore a primary purpose of the present invention to provide a method for forming a panel from sorghum millet fibers, which permits obtaining fibers from the stalks of sorghum millet and forming such sorghum millet fibers into a panel having a certain strength in a desired uneven, two- or three-dimensional shape.

In order to achieve this purpose, in accordance with the present invention, there is basically provided the steps of:

refining stalks of said sorghum millet to obtain sorghum millet fibers;

admixing a cohesive material with the sorghum millet fibers, to thereby provide a lump of initially cohered sorghum millet fibers;

shaping such lump of initially cohered sorghum millet fibers in the form of a mat, to thereby provide a mat of cohered sorghum millet fibers; and pressing and forming such mat of cohered sorghum millet fibers into a predetermined shape of panel.

Accordingly, the refined sorghum millet fibers, when formed in the mat shape after having been initially cohered together as above, remain a base material occupying most of the body of mat, and therefore, this mat per se has much freedom of deformability and can be press formed easily into any shape and configuration with any depth and thickness, during the subsequent pressing step, whereby a desired shape of resultant panel can be formed. Further, the mixing of cohesive material with the sorghum millet fibers enhances the cohesion of the same sorghum millet fibers, thus allowing the fibers to be initially cohered together in the form of a mat and further allowing such mat of cohered sorghum millet fibers to be strongly cohered together integrally by a press working. Hence, a high strength of resultant panel is attained enough for usual use as with other panels and boards.

Another purpose of the present invention is to provide a panel formed by the above-described method.

The cohesive material may preferably comprise chemical fibers each being very thin or small in fineness relative to each of the sorghum millet fibers. The chemical fibers may comprise at least one selected from group consisting of olefin fiber, polyester fiber, polyaclylonitrile fiber, polyamide fiber, polyurethane fiber and polyvinylalcohol fiber.

Also, the cohesive material may preferably comprise natural fibers each being also thin or small in fineness relative to each of the sorghum millet fibers. The natural fibers may comprise at least one selected from group consisting of wood fiber, cotton fiber, wool fiber and other plant fibers including hemp, jute, kenaf and flax fibers.

In one aspect of the present invention, a bonding material may be admixed with the sorghum millet fibers together with the cohesive material. The bonding material may comprise at least one selected from resin materials consisting of a thermosetting resin material, a thermoplastic resin material and a low-melting-point thermoplastic fiber formed from said thermoplastic resin material.

DETAILED DESCRIPTION OF PREFERRED EMBODIMENTS OF THE INVENTION

Hereinafter, a description will be made of preferred embodiments of the present invention in detail.

At first, in accordance with the present invention, the stalks of sorghum millet stated earlier are beaten or crushed, defibrated and refined so as to attain a great number of sorghum millet fibers, and those fibers are utilized to form a predetermined panel.

In summary, a panel of the present invention is a press-formed panel product of cohered sorghum millet fibers, which is formed by such processes that the foregoing refined sorghum millet fibers, which are incompletely cohered with one another, are mixed with a cohesive material so as to sufficiently cohere the sorghum millet fibers with one another via the cohesive material, and then formed in a plate-like mat shape having a substantive thickness, after which, the mat undergoes a press working process so that it is shaped in a desired two- or three-dimensional configuration, wherein the cohesive material is compressed and changed into a state where it acts as a bonding agent, thereby strongly cohering the sorghum millet fibers integrally together.

Now, more specifically stated, as a means for producing the refined sorghum millet fibers, there are provided beating (or crushing), defibrating and refining processes as normally found in the refining of raw hemp stems, sugarcanes, or other stems or stalks of jute, kenaf, flax, etc. Those series of processes shall be referred to as a "refining process", hereinafter, and the wording, "to refine" or "refined", which will appear in this description, shall be defined hereby to imply the beating, crushing and defibrating steps inclusive. In such refining process, the sorghum millet stalks may be subjected to one of the following two known processes: a wet-type refining process and a dry-type refining process. In brief, in the wet-type refining process, the sorghum millet stalks are first made soft by soaking them in water or by leaving them in a moist circumstance (e.g. by applying a steam thereto) and then defibrated and refined into a great number of fibers. On the other hand, in the dry-type refining process, the sorghum millet stalks in a naturally dried state are first beaten or crushed and then defibrated and refined into a great number of fibers.

The wet-type refining process may employ a known refiner of the type for defibrating and refining wood chips, which is provided with a pair of discs having plural defibrating blades formed thereabout. In this case, it is preferred to adjust a gauge or distance between the two discs to a degree of 50$\mu$ so that each sorghum millet fiber to be obtained will be very thin and small in fineness, with its fiber length set at ½ to 2 inches. It is noted here that adjusting such disc distance to a degree smaller than 50$\mu$ may result in the fibers being taken apart thinner into a minute powder-like state, which makes it difficult to refine the fibers technically, and conversely, if the disc distance is adjusted in excess of 50$\mu$, the size of each fiber will increase to an undesirable degree that does not achieve an optimum fineness for a panel aimed for by the present invention.

On the other hand, the dry-type refining process may use a known mechanical beating or crushing type of refiner having a same mechanism with an ordinary crusher or the like, which is equipped with a screening device operable for selecting a given fineness of fibers through an adjustable screen mesh provided therein. This process may be adopted for defibrating and refining the sorghum millet stalks, but it has been found defective in generating a large amount of dust and particulate from pith and other tissues of dried sorghum millet stalk during cutting and crushing steps, in contrast to the aforementioned wet-type refining process.

Again, the refiner used in the present invention for both wet-type and dry-type refining processes may be any of known suitable refiners normally available in this technical field, and therefore, further explanation thereon is deleted for the sake of simplicity in description.

After treated by either of those two refining processes, the sorghum millet stalks are defibrated and refined into a great number of fibers as stated above. The fibers thus refined are then collected. At this point, the fibers are merely contacted with one another; in other words, they can not be cohered completely with one another because of their substantial straight orientations. Such collected sorghum millet fibers are mixed with a cohesive material to be described later, so that the fibers are cohered together via the cohesive material, enough to form a lump of initially cohered sorghum millet fibers. It is noted that, at this stage, the cohesive material used is chemical or natural fibers as will be explained, and normally, the chemical or natural fibers are very thin and in a twisted state, thus tending to be entangled with the sorghum millet fibers, which serves to initially cohere the sorghum millet fibers with one another into the foregoing one lump of initially cohered fibers. Thereafter, such one lump of initially cohered sorghum millet fibers are shaped in a mat form having a substantive thickness, whereupon a mat of cohered sorghum millet fibers is produced.

The cohesive material stated above may preferably be chemical fibers, each being very thin or small in fineness relative to the sorghum millet fiber, such as olefin fibers, polyester fibers, polyaclylonitrile fibers, polyamide fibers, polyurethane fibers, and polyvinylalcohol fibers. Those chemical fibers present in the foregoing mat of sorghum millet fibers are compressed by a subsequent press working process to be described later and changed into a state where it acts as a bonding agent, thereby strongly and completely cohering the sorghum millet fibers together in an integral manner.

In this mixing step, it is optional whether only one of the above-noted chemical fibers is admixed with the refined sorghum millet fibers, or two or more of the chemical fibers are admixed with the same sorghum millet fibers.

As desired, together with the chemical fibers, one or more of natural fibers may be admixed with the refined sorghum millet fibers. Preferably, the natural fibers may include such animal fibers as wool fibers or such plant fibers as wood, hemp, jute, kenaf, flax or the like. In this regard, the wood fibers contain a lignin, an effective element for increasing the bonding power of wood fiber per se, and therefore, it may be advisable to admix the wood fibers with the refined sorghum millet fibers.

Accordingly, it is appreciated that cohesion of refined sorghum millet fibers can be effected and reinforced by admixing one or more of the above-noted cohesive materials therewith.

Next, as will be explained more specifically later, the thus-formed mat of initially cohered sorghum millet fibers, which comprises the refined sorghum millet fibers and cohesive materials, is subjected to a press working process, using a predetermined die having uneven die surface. During that process, the cohesive materials are pressed with the sorghum millet fibers. Due to this pressing, the cohesive materials are compressed and changed into a state like a bonding agent to strongly cohere the sorghum millet fibers integrally with one another, while the mat is deformed between uneven die surfaces of a forming press into a predetermined uneven (two- or three-dimensional) shape, whereupon a desired uneven configuration of panel is formed.

In accordance with the present invention, the refined sorghum millet fibers, when formed in the mat shape after having been initially cohered together as above, remain a base material occupied most in the body of mat. Therefore, the mat of sorghum millet fibers per se has much freedom of deformability and can be press formed easily into any shape and configuration with any depth and thickness, during the subsequent press working process, whereby a desired shape of resultant panel can be formed. Further, the mixing of cohesive material with the sorghum millet fibers enhances the cohesion of the same sorghum millet fibers, thus allowing the fibers to be initially cohered together in the form of a mat and further allowing such mat of cohered sorghum millet fibers to be strongly cohered together integrally by the press working process. Hence, a high strength of resultant panel is attained enough for usual use as with other panels.

Turning back to the mixing step, it is added that a bonding material may also be admixed with the refined sorghum millet fibers together with the above-noted cohesive materials which include both or one of the chemical and natural fibers listed above. The bonding material may be a thermosetting resin material, a thermoplastic resin material or low-melting-point thermoplastic fibers formed from the thermoplastic resin material. As the thermosetting resin material, one or more of the following resin materials may be properly selected, depending on an intended property of resulting panel: a phenol resin, a melamine resin, and a urea resin. Likewise, as the thermoplastic resin material, one or more of the following resin materials may be properly selected: a polyurethane resin, olefin resin and polyacrylic resin. Those resin materials are not limitative, but may be any other resin materials insofar as they will suitably assist in achieving the purposes of the present invention.

With regard to those bonding materials, it is important that the bonding material(s) should be admixed with the refined sorghum millet fibers together with the cohesive material(s), at 10–40% by weight against a unit weight obtained from a total weight of the sorghum millet fibers and cohesive material(s). Experiment shows that less than 10% by weight of the bonding material in that mixing process does not achieve a desired strength of resultant panel. Needless to state, any of the cohesive and bonding materials should be admixed well and evenly with the refined sorghum millet fibers to provide an uniform mixture suited for forming a good quality panel at a subsequent press working process.

In the case where the thermosetting resin bonding material is admixed with the refined sorghum millet fibers together with the cohesive material, a lump of initially cohered sorghum millet fibers obtained by this mixing is formed in the shape of a mat as described earlier and then subjected to a thermocompression press working process. At this particular forming process, the mat of cohered sorghum millet fibers is placed on a predetermined uneven die surface of a die of a known thermocompression-type forming press and pressed thereby under a predetermined degree of temperature for a predetermined time, so that a desired shape of panel is obtained.

In the case where the thermoplastic resin bonding material or low-melting-point thermoplastic fiber as the bonding material is admixed with the refined sorghum millet fibers together with the cohesive material, a lump of initially cohered sorghum millet fibers obtained by this mixing is formed in the shape of mat as described earlier and then subjected to a cold press working process. In this cold press working process, the mat of cohered sorghum millet fibers is preheated, using a suitable heating plate, so as to be softened in advance, and then placed on a predetermined uneven die surface of a die of a known cold forming press. The mat is then pressed by the die for a predetermined time, whereby a desired shape of panel is obtained.

The use of thermosetting resin bonding material requires attention to the fact that the cured resin in the thermocompression press working is incapable of reactivation for renewed use. By contrast, free of such problem is the use of thermoplastic resin bonding material or low-melting-point thermoplastic fiber, because the resin per se, even if cured in the cold press forming process, can be reheated and reactivated for fresh use.

Now, specific examples will be elaborated for forming a panel from the sorghum millet fibers.

In the present example, a wet-type refining process described above is employed. Namely, plural sorghum millet stalks are cut into pieces each being 50 mm long, and these pieces are softened by soaking them in warm water or by applying a steam thereto for 20 to 40 minutes. Then, a known refiner suited for this refining process is so controlled to adjust the distance between its two defibering discs to a degree within 0.1 to 0.05 mm. The sorghum millet stalk pieces are introduced into that refiner and refined thereby to produce a great number of fibers each having a fineness of 10 to 50 denier and a fiber length of 15 to 50 mm.

The sorghum millet fibers thus refined were subjected to the following two examples of panel forming processes.

EXAMPLE 1

50% of cotton fibers (as a cohesive material) and 52 portion of phenol resin powders (as a thermosetting resin bonding material) were admixed with 50% of the sorghum millet fibers so as to initially cohere the sorghum millet fibers together, whereby a lump of initially cohered sorghum millet fibers was provided. This fiber lump was formed in the shape of a mat having a substantive thickness. Then, the mat was treated by a known, suitable thermocompression-type forming press, such that it was compressed while being heated at 200° C. for 60 sec. During this period of time, the cotton fibers and phenol resin powders were transformed into a state like a bonding agent, thus strongly cohering the sorghum millet fibers integrally together into a thin plate-like shape. As a result, a panel of approx. 2.5 mm in thickness was obtained.

EXAMPLE 2

20% of hemp fibers and 50% of cotton fibers (as a cohesive material) and 52 portion of phenol resin powders (as a thermosetting resin bonding material) were admixed with 50% of the sorghum millet fibers so as to initially cohere the sorghum millet fibers together, whereby a lump of initially cohered sorghum millet fibers was provided. This fiber lump was formed in the shape of a mat having a substantive thickness. Then, the mat was treated by a known, suitable thermo-compression-type forming press, such that it was compressed while being heated at 200° C. for 60 sec. Of course, during this period of time, the hemp fibers, cotton fibers and phenol powders were transformed into a state like a bonding agent, thus strongly cohering the sorghum millet fibers integrally together into a thin plate-like shape. As a result, a panel of approx. 2.5 mm in thickness was obtained.

In this Example 2, the hemp fibers may be replaced by other plant fibers, such as jute, kenaf or flax fibers, and also 20% of one of such other plant fibers may be used in the present mode of process. Theoretically, still other sorts of plant fibers may be used if they act as cohesive materials suited for forming the foregoing panel.

Physical property test and comparison were conducted on the above two panels, Example 1 and Example 2, against a wood panel under the trade name, NPP2020, and a hemp-cotton panel under the trade name, JSC5220. The result is shown in TABLE 1 and TABLE 2 below. The TABLE 1 shows a basic physical nature on each of those four panels, which is examined independently from the two directions: the widthwise and lengthwise directions of each panel. All the valued indicated in this table are mean values.

TABLE 1

| Panel | Weight per Unit Area ($g/m^2$) | Thickness (mm) | Specific Gravity |
|---|---|---|---|
| Example 1 | | | |
| widthwise: | 2380 | 2.60 | 0.92 |
| lengthwise: | 2080 | 2.66 | 0.78 |

TABLE 1-continued

| Panel | Weight per Unit Area (g/m$^2$) | Thickness (mm) | Specific Gravity |
|---|---|---|---|
| Example 2 | | | |
| widthwise: | 2810 | 2.60 | 1.08 |
| lengthwise: | 2360 | 2.69 | 0.88 |
| NPP2020 | | | |
| widthwise: | 2170 | 2.63 | 0.83 |
| lengthwise: | 2180 | 2.70 | 0.81 |
| JSC5220 | | | |
| widthwise: | 2020 | 2.61 | 0.77 |
| lengthwise: | 2030 | 2.68 | 0.76 |

Strength test was conducted on each of those four panels in terms of a maximum load (applied to each panel) and an elasticity grade. Likewise as in the TABLE 1, the test was done independently in each of the widthwise and lengthwise directions of each panel. The result is found in the TABLE 2 below, wherein evaluation is based on the value of specific gravity conversion (i.e."*Conv." or "**Conv." in the table) per panel. The specific gravity conversion is effected by dividing the maximum load or the elasticity grade by the specific gravity given in the TABLE 1. It is noted that all the values in the TABLE 2 are mean values.

TABLE 2

| Panel | Maximum Load (kgf) | *Conv. | Elasticity Grade (kgf) | **Conv. |
|---|---|---|---|---|
| Example 1 | | | | |
| widthwise: | 10.9 | 11.85 | 20.3 | 22.1 |
| lengthwise: | 8.37 | 10.73 | 12.5 | 16.0 |
| Example 2 | | | | |
| widthwise: | 12.8 | 11.85 | 19.5 | 18.1 |
| lengthwise: | 8.62 | 9.80 | 11.8 | 13.4 |
| NPP2020 | | | | |
| widthwise: | 9.85 | 11.87 | 15.6 | 18.8 |
| lengthwise: | 9.76 | 12.05 | 13.6 | 16.8 |
| JSC5220 | | | | |
| widthwise: | 12.2 | 15.84 | 17.1 | 22.2 |
| lengthwise: | 9.86 | 12.97 | 13.8 | 18.2 |

1) "*Conv." refers to specific gravity conversion from the maximum load.
2) "**Conv." refers to specific gravity conversion from the elasticity grade.

Comparative review of the two tables above indicates that the panels formed in accordance with the present invention (Examples 1 and 2) are substantially equal in strength to the wood and hemp-cotton panels (NPP2020 and JSC5220). Thus, the sorghum millet fiber panel formed in accordance with the present invention can be used in many fields with a reliable strength, which also permits its use as a substitute for wood panels or expensive natural wood panels.

In addition, further experiments show that admixing 10 to 70% of the cohesive material(s) and 10 to 40% of the bonding materials with 100% of refined sorghum millet fibers will result in obtaining an optimum mat of initially cohered sorghum millet fibers which can be more easily formed in any desired uneven shape of panel through one of the aforementioned thermocompression and cold press working processes.

While having described the present invention thus far, it should be understood that the invention is not limited to the above-described modes, but any other modification, replacement and addition may be applied thereto without departing from the scopes of the appended claims.

What is claimed is:

1. A method for forming a panel from fibers of sorghum millet, comprising the steps of:

refining stalks of said sorghum millet to obtain sorghum millet fibers;

providing a cohesive material which comprises chemical fibers, each being small in fineness relative to each of said sorghum millet fibers;

admixing said cohesive material with said sorghum millet fibers, to thereby provide a lump of initially cohered sorghum millet fibers;

shaping said lump of initially cohered sorghum millet fibers in form of a mat, so as to provide a mat of cohered sorghum millet fibers; and pressing and forming said mat of cohered sorghum millet fibers into a predetermined shape of a panel.

2. A panel formed in accordance with said method as defined in claim 1.

3. The method as defined in claim 1, wherein said chemical fibers comprise at least one selected from group consisting of olefin fiber, polyester fiber, polyaclylonitrile fiber, polyamide fiber, polyurethane fiber and polyvinylalcohol fiber.

4. The method as defined in claim 1, wherein said sorghum millet fibers each has a fineness of 10 to 50 denier.

5. The method as defined in claim 1, wherein said stalks of sorghum millet are subjected to said refining so as to obtain said sorghum millet fibers each having a fineness of 10 to 50 denier and a fiber length of 15 to 50 mm, wherein, the method further includes the steps of: providing 50 parts by weight of said sorghum millet fibers; providing 50 parts by weight of cotton fibers as said cohesive material; and providing another 52 parts by weight of phenol resin powders as a bonding material having a thermosetting property, wherein all said sorghum millet fibers, cotton fibers and phenol resin powders are mixed together at the step of admixing said cohesive material with said sorghum millet fibers, so as to provide a lump of initially cohered sorghum millet fibers is shaped in said form of mat, and then, at the step of pressing and forming the mat of cohered sorghum millet fibers into said predetermined shape of panel, the thus-shaped mat of cohered sorghum millet fibers is subjected to press working operation, using a thermocompression-type forming press, such that said mat of cohered sorghum millet fibers is compressed while being heated at 200° C. for 60 min., whereby a predetermined shape of panel is produced.

6. A panel, formed in accordance with the method as defined in claim 5.

7. The method as defined in claim 1, wherein said stalks of sorghum millet are subjected to said refining so as to obtain said sorghum millet fibers each having a fineness of 10 to 50 denier and a fiber length of 15 to 50 mm, wherein the method further includes the steps of: providing 30 parts by weight of said sorghum millet fibers; providing 20 parts by weight of hemp fibers as said cohesive material; providing 50 parts by weight of cotton fibers as said cohesive material; and providing another 52 parts by weight of phenol resin powders as a bonding material having a thermosetting property, wherein all said sorghum millet fibers, hemp fibers, cotton fibers and phenol resin powders are mixed together at the step of admixing said cohesive material with said sorghum millet fibers, so as to provide a lump of initially cohered sorghum millet fibers, after which, said lump of initially cohered sorghum millet fibers is shaped in said form of mat, and then, at the step of pressing and forming the mat of cohered sorghum millet fibers into said predetermined shape of panel, the thus-shaped mat of cohered sorghum millet fibers is subjected to press, such that said mat of cohered sorghum millet fibers is compressed while being heated at 200° C. for 60 min., whereby a predetermined shape of panel is produced.

8. A panel formed in accordance with said method as defined in claim 7.

9. A method for forming a panel from fibers of sorghum millet, comprising the steps of:

refining stalks of said sorghum millet to obtain sorghum millet fibers;

providing a cohesive material which comprises natural fibers, each being small in fineness relative to each of said sorghum millet fibers;

admixing said cohesive material with said sorghum millet fibers, to thereby provide a lump of initially cohered sorghum millet fibers;

shaping said lump of initially cohered sorghum millet fibers in form of a mat, so as to provide a mat of cohered sorghum millet fibers; and pressing and forming said mat of cohered sorghum millet fibers into a predetermined shape of a panel.

10. A panel formed in accordance with said method as defined in claim 9.

11. The method as defined in claim 9, wherein said natural fibers comprise at least one selected from plant fiber and animal fiber, and wherein said plant fiber includes wood, cotton, hemp, jute, kenaf and flax fibers, whereas said animal fiber includes wool fibers.

12. The method as defined in claim 9, wherein said sorghum millet fibers each has a fineness of 10 to 50 denier.

13. A method for forming a panel from fibers of sorghum millet, comprising the steps of:

refining stalks of said sorghum millet to obtain sorghum millet fibers;

providing a cohesive material which comprises fibers selected from a group of chemical fibers and natural fibers, wherein said chemical and natural fibers are each small in fineness relative to each of said sorghum millet fibers;

admixing said cohesive material with said sorghum millet fibers, to thereby provide a lump of initially cohered sorghum millet fibers;

shaping said lump of initially cohered sorghum millet fibers in form of a mat, so as to provide a mat of cohered sorghum millet fibers; and pressing and forming said mat of cohered sorghum millet fibers into a predetermined shape of a panel, using a forming press means which includes one of thermocompression-type and cold-type forming presses.

14. A panel formed in accordance with said method as defined in claim 13.

15. The method as defined in claim 13, wherein said thermosetting resin material comprises at least one selected from group consisting of phenol resin, melamine resin and urea resin, and wherein said thermoplastic resin material comprises at least one selected from group consisting of polyurethane resin, olefin resin and polyacrylic resin.

16. The method as defined in claim 13, wherein said bonding material is admixed with said sorghum millet fibers at 10 to 40% by weight against a unit weight obtained from total weight of said sorghum millet fibers and cohesive material.

17. The method as defined in claim 13, wherein 10 to 70% of said cohesive material and 10 to 40% of said bonding material are admixed with 100% of said sorghum millet fibers.

* * * * *